343-872 SR
7/27/76 XR 3,972,045

United States Patent [19]
Perret

[11] 3,972,045
[45] July 27, 1976

[54] AIRCRAFT WITH TELEVISION SYSTEM

[75] Inventor: Ludwig A. Perret, La Canada, Calif.

[73] Assignee: Bell & Howell Company, Chicago, Ill.

[22] Filed: May 20, 1974

[21] Appl. No.: 471,253

[52] U.S. Cl. ..... 343/705; 343/765; 343/872
[51] Int. Cl.[2] ..... H01Q 1/28
[58] Field of Search ..... 343/705, 708, 795, 818, 343/765, 766, 872

[56] References Cited

UNITED STATES PATENTS

| | | | |
|---|---|---|---|
| 2,503,109 | 4/1950 | Harris | 343/705 |
| 2,554,119 | 5/1951 | Perham | 343/765 |
| 2,908,904 | 10/1959 | Van Atta et al. | 343/708 |
| 3,710,337 | 1/1973 | Grant | 343/812 |
| 3,721,990 | 3/1973 | Gibson et al. | 343/795 |

*Primary Examiner*—Eli Lieberman
*Attorney, Agent, or Firm*—Benoit Law Corporation

[57] ABSTRACT

Apparatus for transporting and entertaining passengers comprise an aircraft, a rotary supporting structure, equipment connected to the aircraft and to the rotary supporting structure for mounting the rotary supporting structure in the aircraft, a set of antenna elements constituting a directional television antenna on the rotary supporting structure for receiving transmitted television signals, equipment for selectively changing the orientation of the directional television antenna, including equipment coupled to the supporting structure for selectively rotating the supporting structure, and equipment connected to the directional television antenna for processing and displaying the received television signals inside the aircraft.

In an aircraft, there is provided a structural member on the outside of the aircraft of a material permeable to transmitted television signals. A container of electrically insulating material is located inside the aircraft and adjacent the permeable structural member. This container has a circular peripheral rim portion and a pair of spaced sheets located at opposite ends of the circular rim portion and delimiting a circular hollow space having a height smaller than its radius. A rotary supporting structure is located in the container. A set of antenna elements constituting a directional television antenna are located on the rotating supporting structure for receiving transmitted television signals. Equipment for selectively changing the orientation of the directional television antenna includes equipment coupled to the supporting structure for selectively rotating the supporting structure. Equipment is connected to the direction television antenna for processing and displaying the received television signals inside the aircraft.

4 Claims, 7 Drawing Figures

AIRCRAFT WITH TELEVISION SYSTEM

BACKGROUND OF THE INVENTION

1. Field of the Invention

The subject invention relates to aircraft and to television entertainment systems for aircraft.

2. Description of the Prior Art

In recent years, many airplanes have been provided with motion picture projecting equipment for entertaining passengers during longer flights. In parallel to this endeavor, attempts have been made to provide passenger entertainment with the aid of electronic video display systems.

Prior-art attempts in the latter area have been sporadic and unsuccessful from a long-term point of view. In particular, the prior art has been unsuccessful in evolving a video entertainment system capable of receiving broadcast television signals off-the-air and of displaying these received television signals aboard the aircraft.

The drawbacks of the lack of such a television receiving and display system aboard aircraft are being felt with increasing severity.

In particular, the personnel in many types of aircraft and on many types of flights is increasingly burdened with various duties leaving less and less time for setting up and supervising motion picture projecting equipment during periods where such entertainment would be most welcomed by passengers.

In the case of electronic video display systems operating from video recordings, such as video tapes, the problem is somewhat alleviated, but experience has shown that a certain amount of attention still has to be devoted by the aircraft personnel to a smooth operation of the equipment and a prevention of undue tampering by unskilled passengers.

In the exploration of a workable alternative, the prior art has made attempts to provide for an acceptable reception of broadcast television programs aboard aircraft. However, prior-art efforts in this direction has foundered on the seeming impossibility to provide an acceptable solution with technologically feasible means.

This has so far deprived airline passengers of a copious source of entertainment, with the expression "entertainment" being used herein not only with a view to passenger diversion, amusement and hospitality, but also with sufficient lattitude to cover passenger information.

In this respect, it has long been recognized as highly desirable that passengers of aircraft be given pertinent information about their destination while still in the air. This traditionally has included reports about the weather and other pertinent data about their place of destination. In recent years, it has become increasingly difficult to provide this information without some inconvenience to the otherwise busy aircraft personnel and at a time when the aircraft passengers are at leisure to listen to it. In principle, this problem could be solved by enabling the passengers to view and listen to television broadcasts emanating from the city or region which they are approaching by air. In this manner, passengers mainly through the news portion of viewed television programs, would be apprized of weather data and other pertinent information about their point of destination.

This would free the aircraft personnel for other important tasks, thereby augmenting the comfort and also the security of the passengers during their flight. Unfortunately, the prior art has so far been unable to provide a kind of television receiving system that would render satisfaction of this strongly felt need possible.

Another strongly felt need arises from the confined nature of air travel which tends to render aircraft personnel and passengers somewhat captive to their mutual moods and sentiments. In this respect, it has been observed that an increasing nervosity of the airline passengers in an uncomfortable or difficult situation tends to project itself to the aircraft personnel even if the same has received training to cope with such situations.

In this respect, it would be highly advantageous if passengers who are caught in a long wait in the aircraft on the ground or who are exposed to weather conditions or other difficulties in the air could be diverted by a viewing of their favorite television programs as they are broadcast at the time. This would work to the benefit of both passengers and personnel and ultimately to the increased comfort and safety of the airline passengers and the flight personnel.

Again, the shortcomings of the prior art have so far rendered the realization of this benefit impossible.

SUMMARY OF THE INVENTION

It is an object of this invention to overcome the above mentioned disadvantages.

It is a related object of this invention to provide improved apparatus for transporting and entertaining flight passengers.

It is a related object of this invention to increase passenger comfort and safety.

It is a further object of this invention to reduce the time and attention required of aircraft personnel in caring for the passengers' entertainment needs.

It is also an object of this invention to provide apparatus for entertaining passengers in an aircraft.

Other objects will become apparent in the further course of this disclosure.

From a first aspect thereof, the invention resides in apparatus for transporting and entertaining passengers, comprising, in combination, an aircraft, a rotary supporting structure having a flat configuration, means connected to said aircraft and to said rotary supporting structure for mounting said rotary supporting structure in said aircraft, said mounting means including means for tilting said rotary supporting structure at an angle of about 45° to a horizontal plane passing through said aircraft, a set of antenna elements constituting a directional television broadcast receiving antenna on said flat rotary supporting structure for receiving transmitted television signals, means for selectively changing the orientation of said directional television antenna, including means coupled to said supporting structure for selectively rotating said supporting structure, and means connected to said directional television antenna for processing and displaying said received television signals inside said aircraft.

From another aspect thereof, the invention resides in apparatus for entertaining passengers in an aircraft, comprising, in combination, a rotary supporting structure including an essentially circular sheet, means connected to said aircraft and to said rotary supporting structure for mounting said rotary supporting structure in said aircraft, a set of antenna elements located on said circular sheet and constituting a directional television broadcast receiving antenna on said rotary supporting structure for receiving transmitted television signals, means for selectively changing the orientation of said directional television antenna, including means coupled to said supporting structure for selectively rotating said supporting structure and means coupled to said supporting structure for selectively tilting said supporting structure relative to a horizontal plane through said aircraft, and means connected to said directional television antenna for processing and displaying said received television signals inside said aircraft.

From another aspect thereof, the invention resides in an aircraft, and, more specifically, in the improvement comprising, in combination, a vertical fin having a portion permeable to transmitted television signals, a rotary supporting structure including an essentially circular sheet in said permeable portion of said vertical fin, a set of antenna elements located on said circular sheet and constituting a directional television broadcast receiving antenna on said rotary supporting structure for receiving said transmitted television signals, means for selectively changing the orientation of said directional television antenna, including means coupled to said supporting structure for selectively rotating said supporting structure and means coupled to said supporting structure for tilting said supporting structure relative to a horizontal plane through said aircraft, and means connected to said directional television antenna for processing and displaying said received television signals inside said aircraft.

From yet another aspect thereof, the invention resides in an aircraft and, more specifically, in the improvement comprising, in combination, a structural member on the outside of said aircraft of a material permeable to transmitted television signals, a container of electrically insulating material located inside said aircraft and adjacent said structural member, said container having a circular peripheral rim portion and a pair of spaced sheets located at opposite ends of said circular rim portion and delimiting a circular hollow space having a height smaller than its radius, a rotary supporting structure located in said container, a set of antenna elements constituting a directional television broadcast receiving antenna on said rotating supporting structure for receiving transmitted television signals, means for selectively changing the orientation of said directional television antenna, including means coupled to said supporting structure for selectively rotating said supporting structure and means for tilting said supporting structure relative to a horizontal plane through said aircraft, and means connected to said directional television antenna for processing and displaying said received television signals inside said aircraft. From still another aspect thereof, the invention resides in an aircraft, and more specifically in the improvement comprising in combination a structural member on the outside of the aircraft of a material permeable to transmitted television signals, a container of electrically insulating material located inside the aircraft and adjacent the structural member, the container having a circular peripheral rim portion and a pair of spaced sheets located at opposite ends of the circular rim portion and delimiting a circular hollow space having a height smaller than its radius, a rotary supporting structure located in the container, a set of antenna elements constituting a directional television broadcast receiving antenna on the rotating supporting structure for receiving transmitted television signals, means for selectively changing the orientation of the directional television antenna, including means coupled to the supporting structure for selectively rotating the supporting structure, means connected to the container for tilting both the container and the supporting structure and antenna elements relative to a horizontal plane through the aircraft, and means connected to the directional television antenna for processing and displaying the received television signals inside the aircraft.

From another aspect thereof, the invention resides in apparatus for transporting and entertaining passengers comprising, in combination, an aircraft, a radome on said aircraft, a radar system in said radome, a rotary supporting structure including an essentially flat sheet, means connected to said aircraft and to said rotary supporting structure for mounting said rotary supporting structure in said radome, a set of antenna elements constituting a directional television broadcast receiving antenna on said essentially flat sheet of said rotary supporting structure, means for selectively changing the orientation of said directional television antenna, including means coupled to said essentially flat sheet for selectively rotating said directional television antenna with said essentially flat sheet, and means connected to said directional television antenna for processing and displaying broadcast television signals received by said directional television antenna.

The expressions "essential" and "essentially" as herein employed refer to the fact that the quality with which this expression is associated is actually present except for incidental deviations not impairing the overall substance of the particular quality.

BRIEF DESCRIPTION OF THE DRAWINGS

The subject invention and its various aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
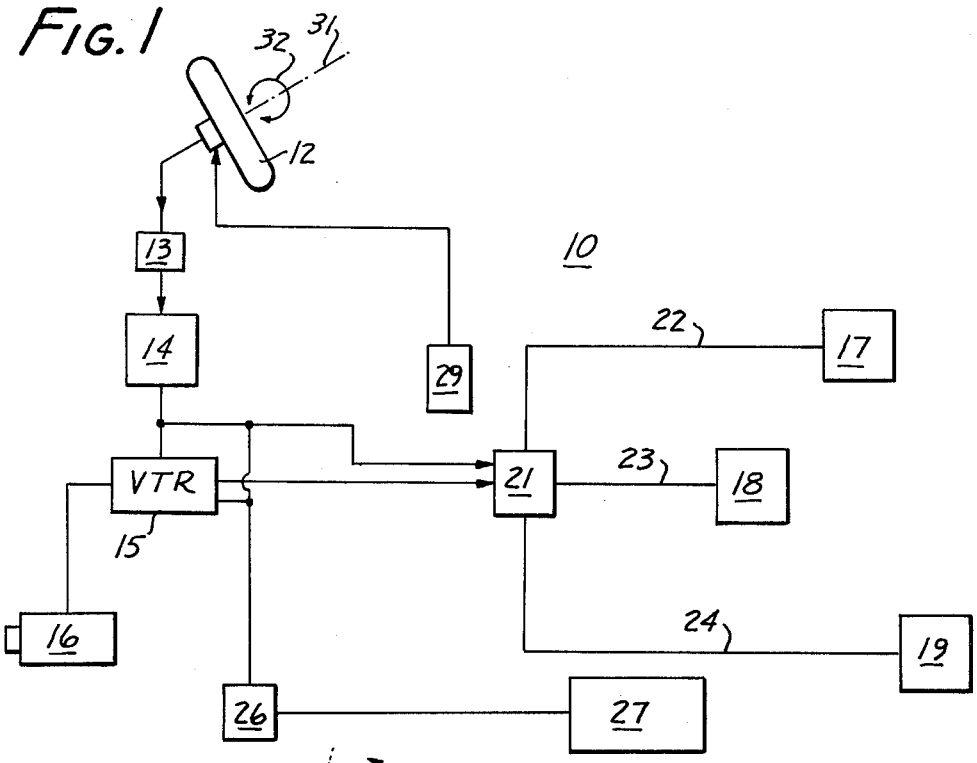
FIG. 1 is a block diagram of a television signal reception and display system according to a preferred embodiment of the subject invention.

The airborne television signal reception and display system 10 shown in FIG. 1 has a rotary antenna 12 of a type more fully described below in connection with FIGS. 2 to 7. A radio frequency amplifier 13 is connected to the antenna 12 to amplify received television signals. These amplified signals are applied to television receiver circuitry 14, including a tuner, not particularly shown, for selecting the television channel which is desired to be viewed.

In the illustrated system, there is also present a video tape recorder and playback machine 15, a video camera 16 and a number of display devices or monitors 17, 18, and 19 distributed through the aircraft to permit passengers to view television programs as they are received by the antenna 12, or to view television programs which have previously been received by the antenna 12 and has been recorded by the video tape recorder 15, or to view other prerecorded programs played back by the equipment 15, or to view scenes picked up by the video camera 16.

Video signals from the television receiving equipment 14 or video tape recorder and playback machine 15 are applied to a video amplifier 21 for amplification and for the purpose of application to the video display devices 17 to 19 via leads 22, 23, and 24.

The audio portion of the received or played-back television program is applied to impedance matching and preamplification equipment 26 and thence to the sound multiplex system 27 of the aircraft.

In summary, there is thus the antenna 12 for receiving broadcast television signals, the radio frequency amplifier 13 for amplifying these received signals, and the equipment 14, 17, 18, 19, 21, 26 and 27 for selecting, detecting, processing, displaying and audibly reproducing the received television signals or programs.

A remote control unit 29 enables the operator to cause rotation of the antenna 14 about an axis 31 as indicated by the arrow symbol 32, so as to orient the antenna for maximum reception.

Figure 2:
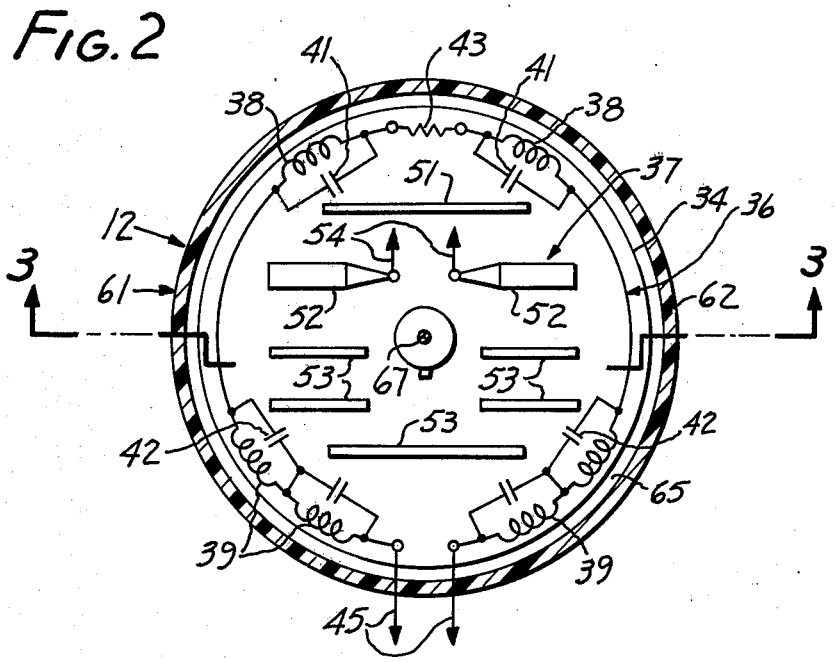
FIG. 2 is a top view of an antenna employed in the system of the subject invention with a top cover being removed therefrom.
Figure 3:
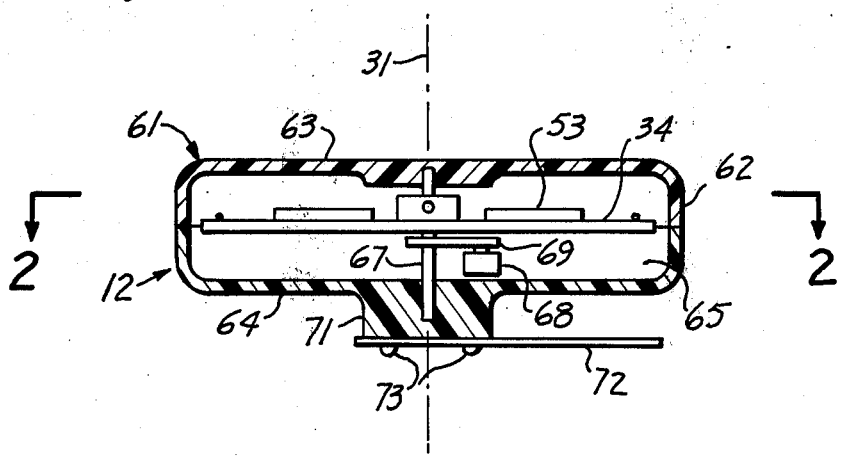
FIG. 3 is a section taken along the line 3—3 in FIG. 2.

Nature and construction of the antenna 12 are more thoroughly shown in FIGS. 2 and 3.

In particular, the antenna structure 12 contains a rotary supporting structure 34 which, as shown in FIGS. 2 and 3, preferably is in the form of an essentially circular sheet. This sheet preferably is of an insulating or dielectric material so as not to interfere with the function of the antenna elements presently to be described.

As shown in FIG. 2, the rotary supporting structure 34 may include at least two antenna systems, such as a very high frequency (VHF) antenna 36 and an ultra high frequency (UHF) antenna 37.

The VHF antenna has the form of a circularly shaped, slot tuned, broad-band uni-directional traveling wave antenna comprising inductances 38 and 39 and associated capacitances 41 and 42, as well as an antenna termination 43, as shown in FIG. 2. A pair of leads 45 connects the VHF antenna 36 to the radio frequency amplifier 13 shown in FIG. 1 and to be more fully described in connection with FIG. 7.

The UHF antenna has a reflector 51, a pair of dipoles 52 and a set of directors 53 mounted or located on the rotary supporting structure 34. A pair of leads 54 connects the UHF antenna 37 to the radio frequency amplifier 13 shown in FIG. 1 and more fully described below in connection with FIG. 7.

Both the VHF antenna 36 and the UHF antenna 37 are of a directional type suitable for receiving transmitted television signals.

The antenna shown in FIGS. 2 and 3 also includes an enclosure 61 of electrically insulating or dielectric material containing the rotary supporting structure 34 and the antennas 36 and 37 and being permeable to transmitted television signals.

In the illustrated antenna, the enclosure 61 has the form of a container having a circular peripheral rim portion 62 and a pair of spaced sheets 63 and 64 located at opposite ends of the circular rim portion and delimiting a circular hollow space 65 having a height smaller than its radius so as to avoid any waste of critical space inside the aircraft.

The rotary supporting structure 34 is attached to a shaft 67 which is rotatably mounted in bearings provided by the sheets 63 and 64 of the container 61. A remotely controlled motor 68 operates through a gear box 69 to rotate the supporting structure 34 about the axis 31 whereby to change the orientation of the directional television antennas 36 and 37. The motor 68 is operated under the direction of the remote control 29 shown in FIG. 1 and more fully described below in connection with FIG. 7.

As seen in FIG. 3, the sheet constituting the rotary supporting structure 34 for the antennas 36 and 37 is preferably of a flat configuration and is located between and in parallel to the sheets 63 and 64 of the container 61. The container 61, in turn, has a mounting hub 71 integral with the sheet 64. The antenna 12 may thus be attached to a mounting bracket 72 by screws 73 or other suitable fasteners.

Figure 4:
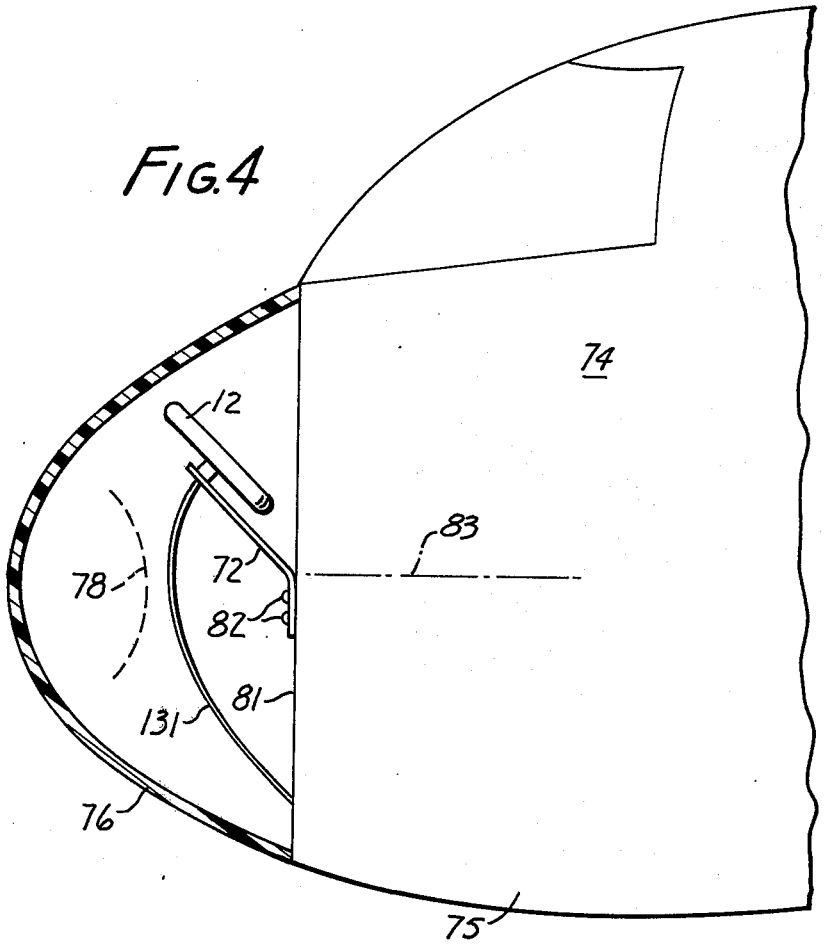
FIG. 4 is a side view, partially in section, of an aircraft implementing a preferred embodiment of the subject invention.

The apparatus 74 shown in FIG. 4 comprises an aircraft part of which is shown at 75 and the antenna system 12 which, of course, includes the rotary supporting structure 34, the antennas 36 and 37 and the container 61 shown in FIGS. 2 and 3. A structural member 76 on the outside of the aircraft is of a material permeable to transmitted television signals. According to FIG. 4, the structural member 76 has the form of a radome forming part of the fuselage of the aircraft. This radome may also include other equipment, such as a radar system shown in dotted lines at 78.

The antenna mounting bracket 72 is attached to a bulkhead 81 of the aircraft by screws 82 or other suitable fasteners. According to the subject invention, and as seen in FIG. 4, the mounting bracket 72 is shaped so as to mount the antenna 12 and thus the rotary supporting structure 34 shown in FIGS. 2 and 3 at an angle relative to a horizontal plane 83 through the aircraft. By way of example, this angle may be about 45°.

Normally, the polarization or orientation of television signals as broadcast in the United States of America is such as to require a horizontal disposition of the antenna and supporting structure 34, that is in parallel to the horizontal plane 83. However, the slanted or tilted position illustrated in FIG. 4 has been conceived and, in practice has been proved to be the best position for the antenna at the illustrated location in the aircraft.

Figure 5:
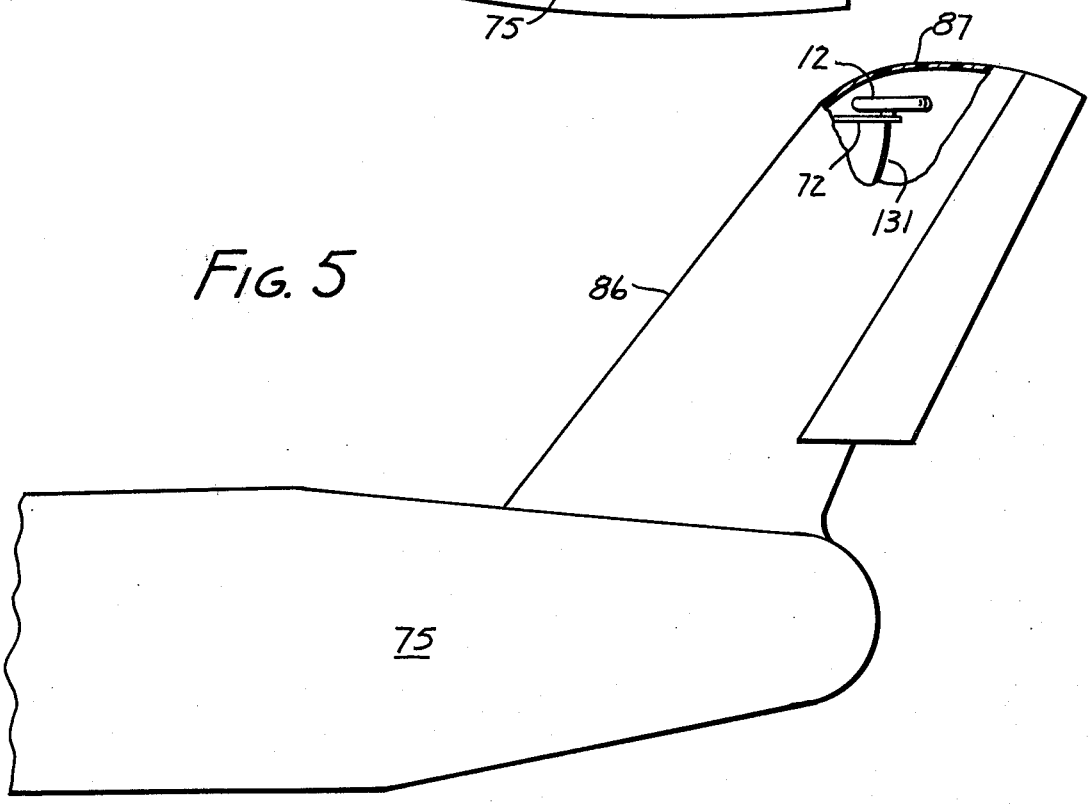
FIG. 5 is a side view, with a part broken away, of an aircraft implementing another preferred embodiment of the subject invention.

According to the preferred embodiment shown in FIG. 5, the vertical fin 86 of the aircraft 75 has a structural member 87 permeable to transmitted television signals and similar to the structural member or radome 76 of the embodiment of FIG. 4. The bracket 72 mounts the antenna 12 inside the permeable structural member 87 of the fin 86.

In FIG. 5, the antenna 12 is shown in a horizontal position. This position may preferably be chosen if a purpose of the antenna is to receive broadcast television signals while the airplane is waiting on the ground.

This has proven to be a considerable comfort and safety factor as it permits passengers to be diverted by their favorite television shows or newscasts during prolonged detentions of the aircraft on the ground whereby the atmosphere inside the aircraft can be maintained at a relaxed and friendly level.

If desired, the antenna in the fin section 86 according to FIG. 5 may be employed in addition to the antenna in the radome section shown in FIG. 4 to permit alternative reception of television signals in the air and on the ground.

In accordance with a further preferred embodiment of the subject invention, the antenna may be made not only rotatable about the axis 31 but also tiltable relative to the horizontal plane 83.

Figure 6:
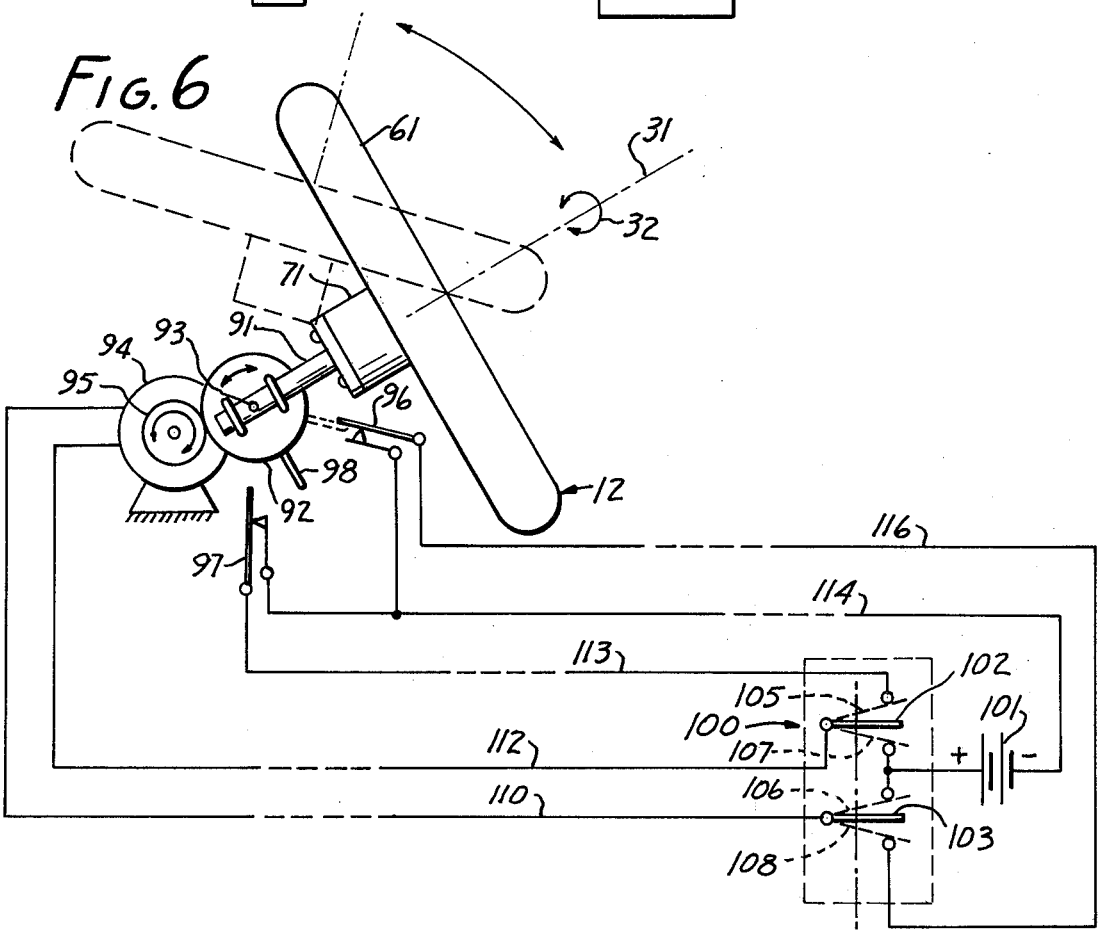
FIG. 6 is a somewhat diagrammatic illustration of a further preferred embodiment of the subject invention.

Methods and means for practicing and implementing the latter principle are illustrated in FIG. 6.

According to FIG. 6, the container 61 of the antenna 12 is mounted at 71 on a mast section 91 which is strapped or otherwise attached to a wheel 92 that is rotatable about a shaft 93. The shaft 93, in turn, may be attached to a baseplate or other supporting structure (not shown) which is mounted on an adjacent part of the aircraft.

An electric motor 94 drives the wheel 92 via another wheel 95. By way of example, the wheels 92 and 95 may be gear wheels. A pair of electric switches 96 and 97 are actuated by a finger 98 which is attached to the wheel 92 in order to limit the tilting travel of the antenna 12.

Operation of the motor 94 is controlled by a polarity reversal switch 100 which may be incorporated into the remote control 29 (see FIG. 1) which is located in or near a passenger compartment of the aircraft.

The motor 94 is preferably of a permanent-magnet field type that is energized from a battery 101 or other suitable source of electric power and that reverses itself of rotation when the polarity of the applied electric drive current is reversed by the polarity reversal switch. The switch 100 has two ganged blades 102 and 103. These blades have an intermediate rest position in which no electric energy is applied to the motor 94 so that the antenna retains its adjusted position. The blades 102 and 103 also have first positions shown at 105 and 106, and second positions shown at 107 and 108, respectively.

To cause rotation of the wheel 92 in a clockwise sense as seen in FIG. 6, the switch 100 is actuated so that the switch blades 102 and 103 are positioned into their first positions 105 and 106. In that case, the following energizing circuit is established for the motor 94:

Positive terminal of battery 101, switch 103, lead 110, motor 94, lead 112, switch 102, lead 113, limit switch 97, lead 114, and negative terminal of battery 101.

The motor then rotates the wheel 92 and tilts the antenna 12 until the switches 102 and 103 are released to their rest position whereby energization of the motor is interrupted. If the switches 102 and 103 are not released to their rest position prior to impingement of the finger 98 onto the switch 97, then the energization of the motor 94 will be interrupted and the tilting motion of the antenna 12 will be stopped upon opening of the switch 97 by the finger 98.

Counterclockwise rotation of the wheel 92 and tilting of the antenna 12 proceeds in a similar fashion. In particular, advancement of the switches 102 and 103 to their second positions 107 and 108 establishes the following energizing circuit for the motor 94:

Positive terminal of the battery 101, switch 102, lead 112, motor 94, lead 110, switch 103, lead 116, limit switch 96, lead 114, and negative terminal of the battery 101.

Tilting motion of the antenna 12 is stopped at a desired point either by releasing the switches 102 and 103 to their rest position or by opening of the limit switch 96 through impingement of the finger 98 on the wheel 92.

It will thus be recognized that the invention as implemented in FIG. 6 permits the operator to change and adjust the orientation of the antennas 36 and 37 not only about a vertical axis 31 to the plane of the antenna structure, but also relative to a horizontal plane 83 through the aircraft.

In this manner, the antenna may be oriented in two respects for maximum reception of broadcast television signals from the ground and for various positions and orientations of the aircraft, be it in the air or on the ground.

A further possibility of antenna adjustment could be provided by employing a gimbal structure (not shown) for tilting the antenna 12 relative to the horizontal 83 in two different planes. This enhanced adjustment may be in addition to the rotary adjustment about the axis 31 for maximized reception of broadcast television signals under a variety of different conditions and attitudes.

While the antenna 12 is not limited in its nature and constructions to any particular make or model, there exists a suitable antenna in the form of the RCA Mini-State TV Antenna System, Model 5MS440. This antenna comes with a signal processing and control circuit of the type shown in FIG. 7.

Figure 7:
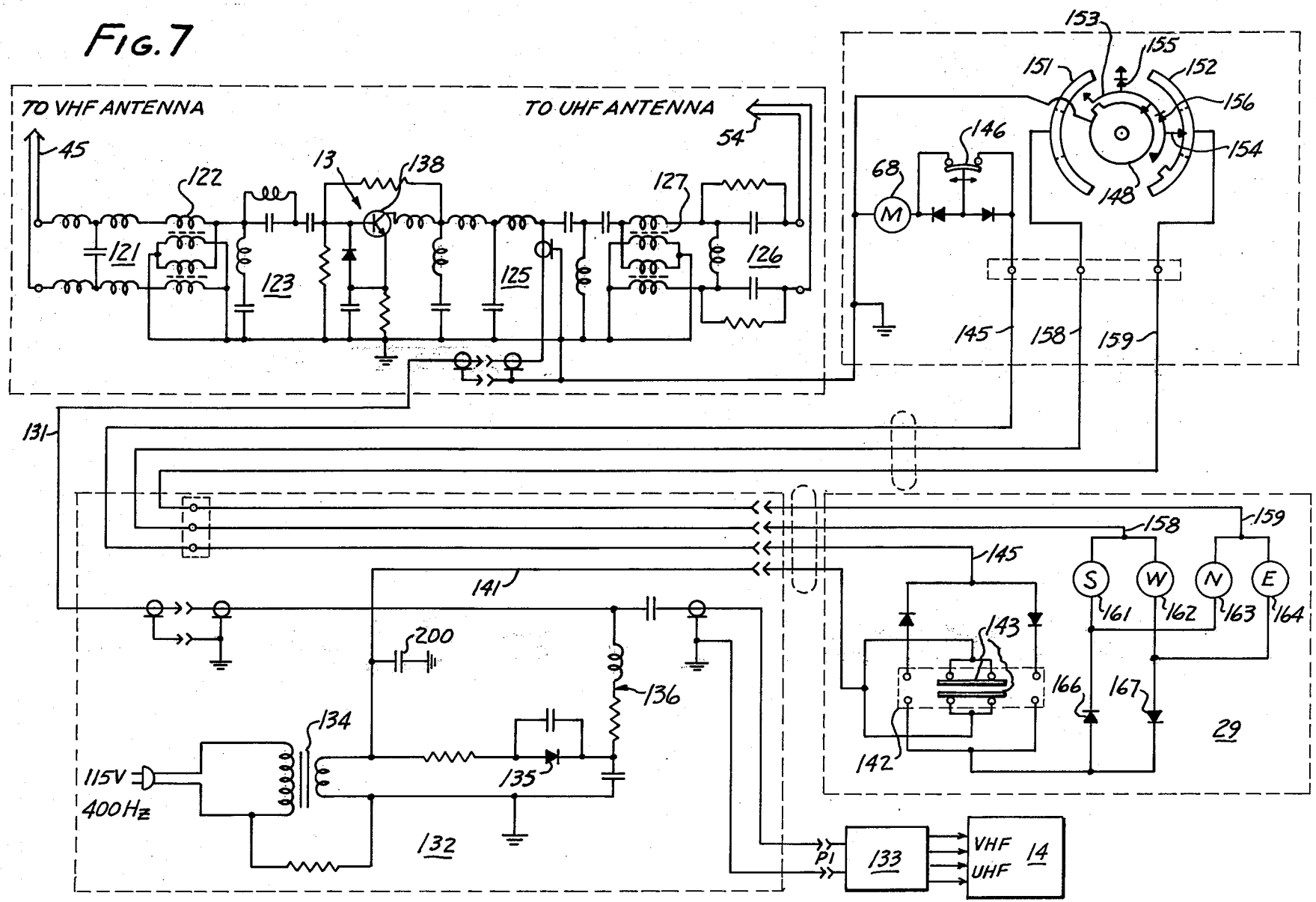
FIG. 7 is a circuit diagram of equipment that may be employed in the practice of the subject invention.

In particular, the radio frequency amplifier 13 is integrated in the circuit of FIG. 7 and is fed with signals from the VHF antenna 36 via a filter 121, a transformer 122 and a filter section 123. The output of the RF amplifier 13 is applied to an adding circuit 125 to which the signal received by the UHF antenna 37 is also applied via a filter 126 and a transformer 127.

The combined VHF and UHF signals travel along a coaxial cable 131 via a power supply 132 to a band separator 133 which, in turn, applies the separated VHF and UHF signals to the tuner and receiver section 14 of the television signal receiving processing and display equipment shown in FIG. 1.

The power supply 132 may be operated from the 400 Hz power supply of the aircraft. In particular, the power supply includes a transformer 134 a rectifier 135 and electric filter equipment 136 to provide a smooth direct current for energizing the transistor 138 of the radio frequency amplifier 13 via the coaxial cable 131.

The output of the power transformer 134 is also applied via a lead 141 to a switch 142 in the control 29. The switch 142 operates through a pair of alternatively positionable switch elements 143 to energize the motor 68 (see FIGS. 7 and 3) via a lead 145 for alternative rotation in a clockwise and in a counterclockwise sense whereby the antenna supporting structure 34 and the antennas 36 and 37 are rotated clockwise and counterclockwise about the axis 31. A cam driven end stop switch 146 is interposed between the lead 145 and the motor 68 to prevent rotation of the antenna by more than 360°.

In the version shown in FIG. 7, the rotary antenna shaft 67 has a central commutator 148 attached thereto for rotation therewith.

It is the purpose of the commutator 148 to provide for an indication of the antenna position at the control 29 in or near a passenger compartment of the aircraft. To this end, the commutator 148 cooperates with a pair of spaced segments 151 and 152 via leads 153 and 154 and rectifier cells 155 and 156, as well as through wiper contacts symbolized in FIG. 7 by arrows located on the respective leads. A pair of wires 158 and 159 connect the segments 151 and 152 to a set of lamps 161, 162, 163 and 164 which, in turn, are connected to the switch 142 via rectifier cells 166 and 167.

The lamps 161 to 164 are marked S, W, N, and E as they will indicate the direction in which the antenna is oriented at any particular time (e.g. South, West, North, East, South-West, North-East, etc.). Of course, such indication aboard an aircraft which is of itself changing its orientation is not to be taken in an absolute sense, but rather with reference to, say, the longitudinal axis of the aircraft which may arbitrarily be considered as "North" for orientation purposes. All of the lamps 161 to 164 are lit when the antenna has made one full turn of 360°, indicating that the antenna has reached the end of its rotation and that the switch 142 has to be reversed if further changes in position are desired.

As an important element in an aircraft environment, a capacitor 200 is connected between the line 141 and ground. This capacitor 200 acts as an arc supressor relative to the switch 142 to prevent the antenna actuating system from interfering with essential flight instruments of the aircraft.

Various modifications and variations within the spirit and scope of the subject invention will become apparent or be suggested to those skilled in the art by the subject extensive disclosure.

I claim:

1. Apparatus for entertaining passengers in an aircraft, comprising in combination:

a rotary supporting structure including an essentially circular sheet;

means connected to said aircraft and to said rotary supporting structure for mounting said rotary supporting structure in said aircraft;

a set of antenna elements located on said circular sheet and constituting a directional television broadcast receiving antenna on said rotary supporting structure for receiving transmitted television signals;

means for selectively changing the orientation of said directional television antenna, including means coupled to said supporting structure for selectively rotating said supporting structure and means coupled to said supporting structure for selectively tilting said supporting structure relative to a horizontal plane through said aircraft; and means connected to said directional television antenna for processing and displaying said received television signals inside said aircraft.

2. In an aircraft, the improvement comprising in combination:

a vertical fin having a portion permeable to transmitted television signals;

a rotary supporting structure including an essentially circular sheet in said permeable portion of said vertical fin;

a set of antenna elements located on said circular sheet and constituting a directional television broadcast receiving antenna on said rotary supporting structure for receiving said transmitted television signals;

means for selectively changing the orientation of said directional television antenna, including means coupled to said supporting structure for selectively rotating said supporting structure and means coupled to said supporting structure for tilting said supporting structure relative to a horizontal plane through said aircraft; and means connected to said directional television antenna for processing and displaying said received television signals inside said aircraft.

3. In an aircraft, the improvement comprising in combination:

a structural member on the outside of said aircraft of a material permeable to transmitted television signals;

a container of electrically insulating material located inside said aircraft and adjacent said structural member, said container having a circular peripheral rim portion and a pair of spaced sheets located at opposite ends of said circular rim portion and delimiting a circular hollow space having a height smaller than its radius;

a rotary supporting structure located in said container;

a set of antenna elements constituting a directional television broadcast receiving antenna on said rotating supporting structure for receiving transmitted television signals;

means for selectively changing the orientation of said directional television antenna, including means coupled to said supporting structure for selectively rotating said supporting structure and means for tilting said supporting structure relative to a horizontal plane through said aircraft; and means connected to said directional television antenna for processing and displaying said received television signals inside said aircraft.

4. In an aircraft, the improvement comprising in combination:

a structural member on the outside of said aircraft of a material permeable to transmitted television signals;

a container of electrically insulating material located inside said aircraft and adjacent said structural member, said container having a circular peripheral rim portion and a pair of spaced sheets located at opposite ends of said circular rim portion and delimiting a circular hollow space having a height smaller than its radius;

a rotary supporting structure located in said container;

a set of antenna elements constituting a directional television broadcast receiving antenna on said rotating supporting structure for receiving transmitted television signals;

means for selectively changing the orientation of said directional television antenna, including means coupled to said supporting structure for selectively rotating said supporting structure;

means connected to said container for tilting both said container and said supporting structure and antenna elements relative to a horizontal plane through said aircraft; and means connected to said directional television antenna for processing and displaying said received television signals inside said aircraft.

* * * * *